US006831616B1

(12) United States Patent
Vice et al.

(10) Patent No.: US 6,831,616 B1
(45) Date of Patent: Dec. 14, 2004

(54) TRANSMISSION LINE BALUN WITH PARASITIC MODE TERMINATION

(75) Inventors: Michael Wendell Vice, El Granada, CA (US); Sushil Kumar, Milpitas, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 51 days.

(21) Appl. No.: 10/455,272

(22) Filed: Jun. 4, 2003

(51) Int. Cl.[7] ..... H01Q 1/50
(52) U.S. Cl. ..... 343/859; 333/26
(58) Field of Search ..... 343/859; 333/25, 333/26

(56) References Cited

U.S. PATENT DOCUMENTS 4,800,344 A * 1/1989 Graham ..... 333/25
5,628,057 A * 5/1997 Phillips et al. ..... 455/575.7
6,097,349 A * 8/2000 Sanford ..... 343/859
6,111,465 A * 8/2000 Kakuta et al. ..... 330/276

* cited by examiner

*Primary Examiner*—Shih-Chao Chen
(74) *Attorney, Agent, or Firm*—Judy Liao Shia

(57) ABSTRACT

A transmission line balun eliminates unwanted reflection of signal energy coupling to a ground plane. A junction of the conductive segments connected to the unbalanced port on the balun is connected to the ground plane with a resistor. The selected junction is a virtual ground of the balun, so the presence of the resistor does not degrade the balun performance. The resistor dissipates the energy from the parasitic mode propagating with the ground plane so that no signal is reflected back to short out the signal source. The value of the resistor is selected to facilitate maximum termination of the parasitic mode propagation.

13 Claims, 1 Drawing Sheet

TRANSMISSION LINE BALUN WITH PARASITIC MODE TERMINATION

BACKGROUND OF THE INVENTION

A transmission line balun is a passive device used as an interface between a balanced network and an unbalanced network. The balun is commonly used to convert an unbalanced radio frequency (RF) signal source to a balanced signal. However, a problematic side effect of this conversion involves unavoidable coupling between the balun and a nearby ground plane. This phenomenon will be referred to as parasitic mode propagation.

In parasitic mode propagation, some of the energy from the RF signal source propagates between the balun and the ground plane. A narrowband disappearance in frequency response, known as a suckout, occurs at signal frequencies in which the balun has an effective electrical length of (2N+1)90° between the unbalanced port and the balanced port, where N is any integer. At these frequencies, the RF signal source is effectively shorted to ground and causes a narrowband suckout.

Prior art solutions adjusted the length of the conductive segments within the balun to shift the suckout outside the frequency band of interest. However, changing the segment lengths can cause the phase performance, match loss, and/or insertion loss of the balun to suffer. Furthermore, the suckout is only shifted to a different frequency band—it is not completely eliminated.

SUMMARY OF THE INVENTION

In accordance with a preferred embodiment of the present invention, a junction between the conductive segments connected to the unbalanced port on the balun is connected to ground with a resistor to eliminate suckout due to parasitic mode propagation. The selected junction is a virtual ground of the balun, so the presence of the resistor does not degrade the balun performance. The resistor dissipates the energy from the unwanted signal coupling due to parasitic mode propagation, thus preventing the 90 degree phase delay that would short out the RF signal source. The value of the resistor is selected to facilitate maximum termination of the parasitic mode propagation. With all of the parasitic mode propagation terminated, no undesired reflection of energy can occur and the narrowband short circuit seen at the input is completely eliminated.

Further features and advantages of the present invention, as well as the structure and operation of preferred embodiments of the present invention, are described in detail below with reference to the accompanying exemplary drawings. In the drawings, like reference numbers indicate identical or functionally similar segments.

DETAILED DESCRIPTION

Figure 1:
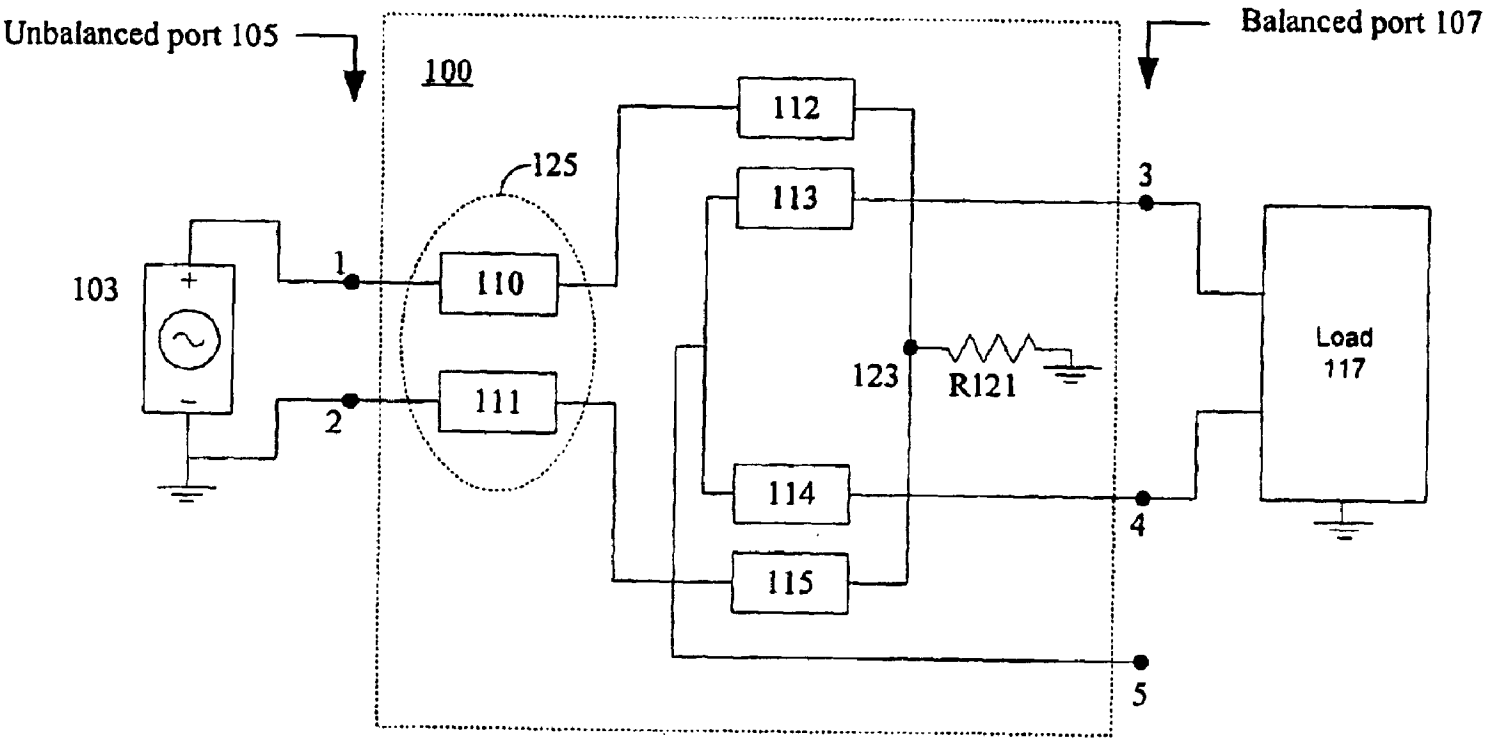
FIG. 1 shows a schematic of a preferred embodiment of a balun, made in accordance with the teachings of the present invention.

FIG. 1 shows a schematic of a preferred embodiment of a balun 100, made in accordance with the teachings of the present invention. The balun 100 converts an unbalanced signal from a radio frequency (RF) signal source 103 to a balanced signal. The balun 100 has an unbalanced port 105 for input from an RF signal source 103 and a balanced port

107 for output of the balanced signal. The unbalanced port 105 consists of terminals 1 and 2. The balanced port 107 consists of terminals 3, 4, and 5. The balanced port 107 is connected to a load 117.

Conductive segments 110, 112, 115, and 11 are connected in series between terminal 1 and terminal 2, respectively. The junction between conductive segments 112 and 115 is designated node 123. Conductive segments 113 and 114 are connected in series between terminal 3 and terminal 4, respectively. The junction between conductive segments 113 and 114 is designated as terminal 5.

Conductive segments 110 and 111 form an electromagnetically coupled pair, and preferably have equal lengths and equal widths. Conductive segments 110 and 111 function as an isolation transformer 125. The isolation transformer 125 is preferably used to isolate the balanced signal from ground, but it is not absolutely necessary to the performance of the balun 100. Conductive segments 112 and 113 form another electromagnetically coupled pair, and so do conductive segments 114 and 115. Conductive segments 112, 113, 114, and 115 preferably have equal lengths and equal widths.

To convert the single-ended RF signal source 103 to a balanced signal, one terminal of the RF signal source 103 is connected to terminal 1, while its other terminal is connected to terminal 2 and grounded. An unbalanced signal applied to the unbalanced port 105 produces a balanced signal at the balanced port 107, by virtue of the electromagnetic coupling between the conductive segments. Assuming the load 117 has symmetric impedance with respect to ground, the conductive segments are arranged so that the signals at terminals 3 and 4 are equal in amplitude with respect to ground, but have a 180° phase difference. As a result, both node 123 and terminal 5 are virtual grounds of the balun 100. Terminal 5 may be grounded to enforce ground centering at the balanced port 107, left floating as a virtual ground, or connected to another circuit external to the balun 100. The selection of materials and the design of the conductive segments are well known to those skilled in the art.

The lengths and widths of all the conductive segments, as well as the separation between the electromagnetically coupled pairs, are preferably selected to match the characteristic impedance of the RF signal source 103 over the frequency band of interest. Terminals 3 and 4 are connected to a load 117. The balun 100 is typically used in a system where the source and load impedances are the same, but this need not always the case.

Previously, the RF signal source 103 would be substantially shorted to ground at frequencies at which the balun has an effective electrical length of (2N+1)90° between terminal 1 and node 123 for the parasitic mode. To prevent this, a resistor R121 connects node 123 to ground. The resistor R121 dissipates the energy from the parasitic mode propagation so that virtually zero signal is reflected back to short out the RF signal source 103. The presence of the resistor R121 does not degrade the balun performance since node 123 is a virtual ground of the balun 100. The value of the resistor R121 is selected to facilitate maximum termination of the parasitic mode propagation arriving at node 123. With most of the parasitic mode propagation terminated at node 123, little or no undesired reflection of energy can occur and the narrowband suckout is essentially eliminated.

The value of resistor R121 matches the characteristic impedance of the parasitic mode propagation between the balun 100 and the ground plane. This value depends primarily on the width of the conductive segments, the dielectric material separating the balun 100 from the ground plane, and the distance between the balun 100 and the ground plane. The appropriate value can be determined empirically or through circuit simulation.

Those with skill in the art will recognize that the balun may be implemented in multiple forms, including: stripline, microstrip, twisted pair, coaxial cables, multifilar wire, etc. The balun may also be used to convert balanced signals to unbalanced ones by attaching a signal source at the balanced port 107 and taking the output from the unbalanced port 105.

Although the present invention has been described in detail with reference to particular preferred embodiments, persons possessing ordinary skill in the art to which this invention pertains will appreciate that various modifications and enhancements may be made without departing from the spirit and scope of the claims that follow.

We claim:

1. A balun, comprising:

an unbalanced port comprising a first and second terminal;

a balanced port comprising a third, fourth, and fifth terminal;

first and second conductive segments respectively connected in series between the first and second terminal;

third and fourth conductive segments respectively connected in series between the third and fourth terminal, the junction between the third and fourth conductive segments comprising the fifth terminal, wherein the first and third conductive segments form an electromagnetically coupled pair, and the second and fourth conductive segments form an electromagnetically coupled pair;

a ground plane; and a resistor connecting the junction between the first and second conductive segments to the ground plane.

2. The balun as in claim 1, wherein the resistor value is selected so as to substantially eliminate unwanted reflection of signal energy in the parasitic mode propagating between the balun and the ground plane.

3. The balun as in claim 2, further comprising an isolation transformer interposing the unbalanced port and the first and second conductive segments.

4. The balun as in claim 3, wherein the first, second, third, and fourth conductive segments have equal lengths and equal widths.

5. The balun as in claim 4, wherein the fifth terminal is connected to ground.

6. The balun as in claim 5, wherein the isolation transformer comprises:

fifth and sixth conductive segments having equal lengths and equal widths that form an electromagnetically coupled pair.

7. The balun as in claim 1, further comprising an isolation transformer interposing the unbalanced port and the first and second conductive segments.

8. The balun as in claim 7, wherein the first, second, third, and fourth conductive segments have equal lengths and equal widths.

9. The balun as in claim 8, wherein the fifth terminal is connected to ground.

10. The balun as in claim 9, wherein the isolation transformer comprises:

fifth and sixth conductive segments having equal lengths and equal widths that form an electromagnetically coupled pair.

11. The balun as in claim 1, wherein the first, second, third, and fourth conductive segments have equal lengths and equal widths.

12. The balun as in claim 11, wherein the resistor value is selected so as to substantially eliminate unwanted reflection of signal energy in the parasitic mode propagating between the balun and the ground plane.

13. The balun as in claim 12, wherein the fifth terminal is connected to ground.

* * * * *